US008778126B2

(12) United States Patent
Fujisawa et al.

(10) Patent No.: US 8,778,126 B2
(45) Date of Patent: Jul. 15, 2014

(54) BASE MATERIAL FOR ARTIFICIAL LEATHER AND GRAINED ARTIFICIAL LEATHER

(71) Applicants: Michinori Fujisawa, Okayama (JP); Jiro Tanaka, Okayama (JP); Yoshiyuki Ando, Okayama (JP); Norio Makiyama, Okayama (JP)

(72) Inventors: Michinori Fujisawa, Okayama (JP); Jiro Tanaka, Okayama (JP); Yoshiyuki Ando, Okayama (JP); Norio Makiyama, Okayama (JP)

(73) Assignee: Kuraray Co., Ltd., Kurashiki-shi (JP)

( * ) Notice: Subject to any disclaimer, the term of this patent is extended or adjusted under 35 U.S.C. 154(b) by 50 days.

(21) Appl. No.: 13/667,752

(22) Filed: Nov. 2, 2012

(65) Prior Publication Data

US 2013/0055535 A1 Mar. 7, 2013

Related U.S. Application Data

(62) Division of application No. 12/302,813, filed as application No. PCT/JP2007/060444 on May 22, 2007, now abandoned.

(30) Foreign Application Priority Data

May 30, 2006 (JP) ..... 2006-150170

(51) Int. Cl.
*D06C 19/00* (2006.01)

(52) U.S. Cl.
USPC ..... 156/308.8; 28/167; 427/370; 264/134

(58) Field of Classification Search
CPC ..... B29D 2030/4437; B29D 30/245; B32B 37/10; B32B 2309/12; B32B 27/00; B29C 65/18; B29C 2791/006; B27D 1/04; B29B 15/04
USPC ..... 442/77; 156/281, 288, 312, 62.6, 296, 156/308.6, 308.8; 264/319, 103, 211.14, 264/211.17; 28/167, 168, 104, 107, 112; 427/370, 371, 384, 385.5, 388.4; 19/304; 38/82, 84, 71, 100, 101
See application file for complete search history.

(56) References Cited

U.S. PATENT DOCUMENTS

| | | | | |
|---|---|---|---|---|
| 3,764,454 | A * | 10/1973 | Healy et al. | 428/218 |
| 2004/0063366 | A1* | 4/2004 | Nakayama et al. | 442/104 |
| 2005/0118394 | A1* | 6/2005 | Tanaka et al. | 428/151 |

(Continued)

FOREIGN PATENT DOCUMENTS

| | | |
|---|---|---|
| JP | 54 59499 | 5/1979 |
| JP | 63 5518 | 1/1988 |

(Continued)

OTHER PUBLICATIONS

Office Action issued on Oct. 11, 2011 in the corresponding Japanese Patent Application No. 2008-517865.

*Primary Examiner* — Katarzyna Wyrozebski Lee
*Assistant Examiner* — Vishal I Patel
(74) *Attorney, Agent, or Firm* — Oblon, Spivak, McClelland, Maier & Neustadt, L.L.P.

(57) ABSTRACT

A method of producing a substrate suitable for artificial leathers. The substrate is composed of an entangled nonwoven fabric made of microfine fibers and a binder resin. At least one surface of the substrate is a densified layer which is made of the microfine fibers and which is substantially free from the binder resin. The binder resin is impregnated into a portion of the substrate other than the densified layer. The densified layer prevents the binder resin impregnated into the entangled nonwoven fabric from migrating into the surface of the entangled nonwoven fabric, thereby providing the substrate having the surface substantially free from the binder resin. The peeling strength between the substrate and a grain layer formed on the surface thereof is drastically improved because the surface of the substrate is substantially free from the binder resin.

19 Claims, 1 Drawing Sheet

(56) References Cited

U.S. PATENT DOCUMENTS

2011/0039055 A1 2/2011 Fujisawa et al.

FOREIGN PATENT DOCUMENTS

JP 4 185777 7/1992
JP 06 264369 9/1994
JP 06 264370 9/1994
JP 06 264371 9/1994
JP 08 113879 5/1996
JP 2000 273769 10/2000
JP 2002 194678 7/2002
JP 2002-242081 8/2002
JP 2004 143616 5/2004
JP 2005-154971 6/2005

* cited by examiner

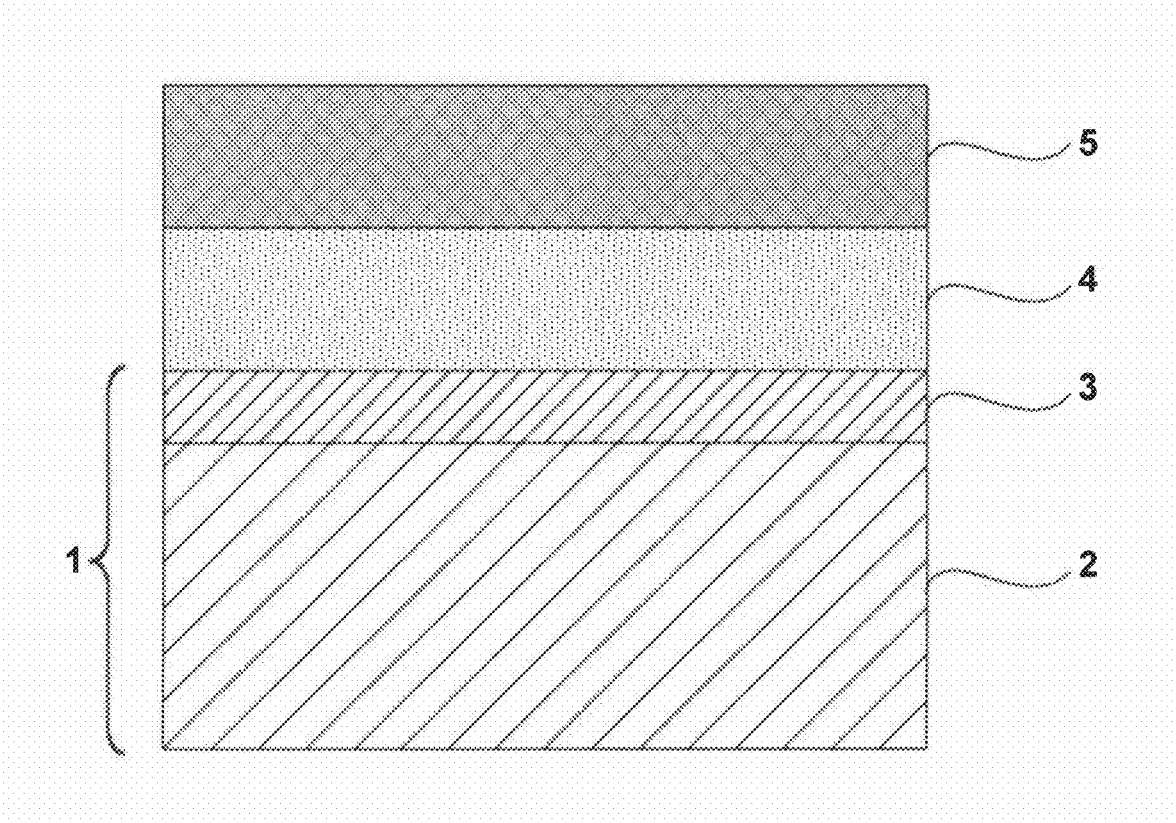
5
4
3
1
2

BASE MATERIAL FOR ARTIFICIAL LEATHER AND GRAINED ARTIFICIAL LEATHER

CROSS-REFERENCE TO RELATED APPLICATIONS

This application is a Divisional of U.S. patent application Ser. No. 12/302,813 filed Dec. 1, 2008 which is a National Stage Entry of PCT/JP07/060,444 filed May 22, 2007, and claims priority to Japanese Patent Application No. 2006-150170 filed May 30, 2006, the disclosures of which are hereby incorporated by reference.

TECHNICAL FIELD

The present invention relates to a substrate for artificial leathers comprising a nonwoven fabric made of bundles of microfine fibers impregnated with an elastic polymer, more specifically, relates to a grain-finished artificial leather combining a high peeling strength, a softness without resistance and a hand with stiffness each meeting the requirement in the application of sport shoes, and further having fine wrinkles formed by bending (bent wrinkles).

BACKGROUND ART

Artificial leathers have come to be widely used in the application fields of clothes, general materials, sports, etc. because their light weights and easiness of handling have been accepted by consumers. In such application fields, artificial leathers are required to meet both the sensory properties such as appearance and hand and the physical properties such as dimension stability. Artificial leathers excellent in appearance, hand, etc. are generally produced by a method including the conversion of microfine fiber-forming fibers into microfine fibers by removing one component therein. A known method generally used for producing artificial leathers which includes the conversion of fibers into microfine fibers are roughly composed of a step (1) in which microfine fiber-forming fibers made of two kinds of polymers having different dissolving properties are made into staple fibers, a step (2) in which the staples fibers are formed into a web by using a carding machine, crosslapper, random webber, etc., a step (3) in which the web is made into an entangled nonwoven fabric by entangling the fibers by a needle punching, etc., a step (4) in which a solution or emulsion of an elastic polymer such as polyurethane is impregnated into the entangled nonwoven fabric and coagulated, and a step (5) in which the microfine fiber-forming fibers are converted into microfine fibers by removing one of their components. The step (4) and step (5) may be carried out in reverse order. By such production methods, soft artificial leathers composed of microfine fibers are obtained.

Unlike a method of using short fibers, a method of using long fibers does not need a series of large apparatuses such as a raw fiber feeder, an apparatus for opening fibers, a carding machine and a cross lay machine. In addition, a nonwoven fabric made of long fibers is advantageous to a nonwoven fabric made of short fibers because of its high strength.

Nonwoven fabrics made from two kinds of long microfine fibers have been mainly produced by a method in which microfine fiber-forming long fibers composed of two or more kinds of incompatible polymers are made into a nonwoven fabric and then the microfine fiber-forming long fibers are converted into microfine fibers by splitting and dividing along the lengthwise direction through the interface between the polymers. However, it is very difficult to split or divide uniformly. Therefore, the obtained nonwoven fabric of long microfine fibers is mainly used in the production of grain-finished artificial leathers, but not suitable for the production of suede-finished artificial leathers. On the other hand, nonwoven fabrics made from a single kind of long microfine fibers have been produced by a method in which microfine fiber-forming long fibers composed of two or more kinds of incompatible polymers (microfine fiber-forming polymer and removable polymer) are made into a nonwoven fabric and then the removable polymer is removed from the multi-component fibers. For example, sodium hydroxide is used for removing polyester, formic acid is used for removing polyamide, and trichloroethylene or toluene are used for removing polystyrene and polyethylene.

The degree of water solubility of polyvinyl alcohol (PVA) which is known as a water-soluble polymer can be adjusted by changing its backbone, molecular structure and molecular form or by modifying the polymer. Further, PVA may be made thermoplastic, i.e., melt-spinnable. It is also known that PVA is biodegradable. Recently, it is imperative for the protection of the global environment to how harmonize synthetic chemicals with the nature. In this connection, PVA and PVA-based resin having such properties attract great attention.

Various artificial leathers having a natural leather-like softness have been proposed. For example, a proposed leather-like sheet is produced by impregnating a polyurethane resin into a nonwoven fabric made of microfine fibers of 1 D or less, wet-coagulating the polyurethane resin to obtain a substrate, and laminating the substrate with a film prepared by coating a polyurethane resin on a release paper. In another proposal, a leather-like sheet is produced by applying a polyurethane solution on the substrate obtained in the same manner as above, wet-coagulating the polyurethane, and then gravure roll-coating a polyurethane/colorant composition. In still another proposal, a leather-like sheet is produced by impregnating a polyurethane resin into an entangled nonwoven fabric made of sea-island fibers, wet-coagulating the polyurethane resin, removing the sea component from the sea-island fibers by dissolution in a solvent, to obtain a substrate made of bundles of microfine fibers of 0.2 D or less, and then, subjecting the substrate to the surface finishing treatment mentioned above (for example, Patent Document 1). Although the proposed leather-like sheets have a softness resembling natural leathers, a grain-finished artificial leather which combines softness without resistance, hand with stiffness and fine bent wrinkles has not yet been obtained.

Further proposed is an artificial leather which is produced by impregnating a high-density nonwoven fabric with a binder resin in an amount smaller than usual (Patent Document 2). However, the proposed artificial leather has a surface with a poor softness and a low interlaminar peeling strength. Therefore, it is insufficient as the material for sport shoes which are used under severe conditions.

Still further proposed is a grain-finished artificial leather made of a nonwoven fabric of long fibers (Patent Document 3). In Patent Document 3, it is described that the strain markedly caused during the entangling treatment of long fibers can be relieved by intendedly cut the long fibers during the entangling treatment by needle punching, thereby exposing the cut ends of fibers to the surface of the nonwoven fabric in a density of 5 to 100/mm$^2$. It is also described that 5 to 70 fiber bundles are present per 1 cm width on the cross section parallel to the thickness direction of the nonwoven fabric of long fibers, i.e., the number of fiber bundles which are oriented by needle punching in the thickness direction is 5 to 70 per 1 cm width of the cross section. It is further described that the total area occupied by fiber bundles on a cross section perpendicular to the thickness direction of the nonwoven fabric of long fibers is 5 to 70% of the cross-sectional area. Although the long fibers are cut to an extent so as to achieve the intended properties, many long fibers are required to be cut to make the nonwoven fabric of long fibers into the proposed structure. Therefore, the advantages of using long fibers that the strength of nonwoven fabric is enhanced because of their continuity are significantly reduced, thereby failing to effectively use their advantages. To cut the fibers on the surface of nonwoven fabric evenly, the entangling treatment should be performed by repeating the needle punching many times under conditions severer than usual, thereby making it difficult to obtain the high-quality structure of long-fiber nonwoven fabric aimed in the present invention.

It is also known that a substrate for artificial leathers having a natural leather-like softness is obtained by impregnating a binder resin to an entangled nonwoven fabric of microfine fiber-forming fibers or bundles of microfine fibers and wet-coagulating the binder resin. However, a binder resin, particularly in the form of aqueous emulsion, present on the surface of the substrate for artificial leathers in a high concentration inhibits the adhesion of a surface layer (grain layer) to the surface of the substrate, thereby making the production of a grain-finished artificial leather having a high peeling strength difficult. For example, Patent Document 4 teaches that when blowing hot air for drying on to one of the surfaces of an entangled nonwoven fabric made of bundles of microfine fibers which is impregnated with an aqueous emulsion of a binder resin, the binder resin migrates mainly into the blown surface and the migration into the other surface is prevented. However, the aqueous emulsion of a binder resin cannot be completely prevented from being present on the non-blown surface by merely preventing the migration. Therefore, a substrate for artificial leathers made of microfine fibers which is free from a binder resin on the surface portion has not yet been obtained.

[Patent Document 1] JP 63-5518B (pages 2-4)
[Patent Document 2] JP 4-185777A (pages 2-3)
[Patent Document 3] JP 2000-273769 (pages 3-5)
[Patent Document 4] JP 54-59499A (pages 1-2)

BRIEF DESCRIPTION OF THE DRAWING

The FIGURE is a schematic cross-sectional view of an embodiment of a grain-finished artificial leather of the present invention.

DISCLOSURE OF THE INVENTION

An object of the present invention is to provide a grain-finished artificial leather which combines a high peeling strength, a softness without resistance and a hand with stiffness each meeting the requirement in the application to sport shoes and further has fine bent wrinkles, and to provide a substrate for artificial leathers capable of producing such a grain-finished artificial leather.

As a result of extensive research in view of achieving the above object, the inventors have found a substrate for artificial leathers which is suitable for the production of the above grain-finished artificial leather and made the present invention.

The present invention relates to a substrate for artificial leathers (1 in the FIGURE) comprising an entangled nonwoven fabric made of microfine fibers and a binder resin, wherein at least one surface of the substrate for artificial leathers is a densified layer (3 in the FIGURE) which comprises the microfine fibers and which is substantially free from the binder resin, and wherein the binder resin is impregnated into a portion (2 in the FIGURE) of the substrate for artificial leathers other than the densified layer. The present invention further relates to a grain-finished artificial leather which comprises the substrate for artificial leathers mentioned above and a grain layer (5 in the FIGURE) comprising an elastic polymer, the grain layer being formed on the densified layer on the surface of the substrate for artificial leathers. The present invention still further relates to a method of producing the substrate for artificial leathers and a method of producing the grain-finished artificial leather.

BEST MODE FOR CARRYING OUT THE INVENTION

The microfine fibers (inclusive of bundles of fibers) which constitute the substrate for artificial leathers of the invention are made by converting multi-component fibers (microfine fiber-forming fibers) into microfine fibers. The multi-component fibers are composed of at least two kinds of spinnable polymers which are chemically or physically different from one another. The conversion into microfine fibers is performed by the extractive removal of at least one kind of polymer at an appropriate production stage before or after the impregnation of an elastic polymer. Examples of the microfine fiber-forming fibers include composite fibers such as sea-island fibers, multilayered fibers, radially laminated fibers, which are produced by a chip blend (mix spinning) method, conjugated spinning method, etc. Preferred are sea-island fibers because the damage during needle punching is small and microfine fibers having a uniform fineness are obtained.

As the island component polymer for the sea-island fibers, preferably usable are fiber-forming polymers, for example, polyester resins such as polyethylene terephthalate (PET), polytrimethylene terephthalate (PTT), polybutylene terephthalate (PBT) and polyester elastomers; polyamide resins such as nylon 6, nylon 66, nylon 610, nylon 12, aromatic polyamides and polyamide elastomers; polyurethane resins; and polyolefin resins, with the polyester resins such as PET, PTT and PBT being particularly preferred because of their easiness of shrinking, good hand of final products and high performance in use. The melting point of the island component polymer is preferably 160° C. or higher in view of dimension stability and performance in use. More preferred are fiber-forming crystallizable resins having a melting point of 180 to 250° C. The method for measuring the melting point will be described below. The island component polymer may be added with a colorant such as dye and pigment, an ultraviolet absorber, a heat stabilizer, a deodorant, a fungicide, and stabilizers.

The sea component polymer for the sea-island fibers is not specifically limited and preferably a polymer which is different from the island component polymer in the solubility and decomposability, less compatible with the island component polymer, and has a melt viscosity or surface tension smaller than those of the island polymer under the spinning conditions. For example, at least one polymer selected from polyethylene, polypropylene, polystyrene, ethylene-propylene copolymers, ethylene-vinyl acetate copolymers, styrene-ethylene copolymers, styrene-acryl copolymers and polyvinyl alcohol resins is used as the sea component polymer. Taking the capability of producing the substrate for artificial leathers without using chemicals, the spinnability of sea-island fibers, the needle punchability, the prevention of environmental pollution, and the easiness of removal into consideration collectively, a water-soluble, thermoplastic polyvinyl alcohol-based resin (PVA-based resin) is preferably used as the sea component polymer.

The viscosity average polymerization degree (polymerization degree P) of PVA-based resin is preferably 200 to 500, more preferably 230 to 470, and still more preferably 250 to 450. If being 200 or more, the melt viscosity is moderately high, and the PVA-based resin is stably made into a composite with the island component. If being 500 or less, the melt viscosity is not excessively high and the extrusion from a spinning nozzle is easy. A PVA-based resin having a polymerization degree of 500 or less, i.e., a low-polymerization degree PVA dissolves quickly in a hot water.

The polymerization degree P is measured according to JIS-K6726, in which a PVA-based resin is re-saponified and purified, and then, an intrinsic viscosity [η] is measured in water at 30° C. The polymerization degree P is calculated from the following equation:

$$P=([\eta]10^3/18.29)^{(1/0.62)}.$$

The saponification degree of the PVA-based resin is preferably 90 to 99.99 mol %, more preferably 93 to 99.98 mol %, still more preferably 94 to 99.97 mol %, and particularly preferably 96 to 99.96 mol %. If being 90 mol % or more, the melt spinning is performed without causing thermal decomposition and gelation because of a good heat stability and the biodegradability is good. Also, suitable sea-island fibers can be obtained without decreasing the water solubility even when modified with a copolymerizable monomer which will be described below. PVA having a saponification degree exceeding 99.99 mol % is difficult to produce stably.

The PVA-based resin is biodegradable and decomposed to water and carbon dioxide by an activated sludge treatment or by being laid underground. It is preferred to treat a PVA-containing waste water, which is resulted from the removal of the PVA resin by dissolution, by activated sludge. The PVA resin is completely decomposed within a period of from two days to one month when the PVA-containing waste water is continuously treated by activated sludge. Since the combustion heat is low to impose little load of heat to an incinerator, the PVA resin may be incinerated after drying the PVA-containing waste water.

The melting point of PVA-based resin (Tm) is preferably 160 to 230° C., more preferably 170 to 227° C., still more preferably 175 to 224° C., and particularly preferably 180 to 220° C. If being 160° C. or higher, the crystallizability is sufficient to enhance the fiber strength and the heat stability is good to make the fiber formation easy. If being 230° C. or lower, the sea-island fibers can be stably produced because the melt spinning can be performed at low temperatures, thereby increasing the difference between the melt-spinning temperature and the decomposition temperature of PVA-based resin. The measuring method of the melting point will be described below.

The PVA-based resin is produced by saponifying a resin mainly constituted by vinyl ester units. Examples of vinyl monomers for the vinyl ester units include vinyl formate, vinyl acetate, vinyl propionate, vinyl valerate, vinyl caprate, vinyl laurate, vinyl stearate, vinyl benzoate, vinyl pivalate and vinyl versatate, with vinyl acetate being preferred in view of easiness of production of the PVA-based resin.

The PVA-based resin may be homo PVA or modified PVA introduced with co-monomer units, with the modified PVA being preferred in view of a good melt spinnability, water solubility and fiber properties. In view of a good copolymerizability, melt spinnability and water solubility, preferred examples of the co-monomers are α-olefins having 4 or less carbon atoms such as ethylene, propylene, 1-butene and isobutene; and vinyl ethers such as methyl vinyl ether, ethyl vinyl ether, n-propyl vinyl ether, isopropyl vinyl ether and n-butyl vinyl ether. The content of the comonomer units in the modified PVA is preferably 1 to 20 mol %, more preferably 4 to 15 mol %, and still more preferably 6 to 13 mol % base on the total constitutional units in the modified PVA. Particularly preferred is ethylene-modified PVA, because the fiber properties are enhanced when the comonomer unit is ethylene. The content of the ethylene units is preferably 4 to 15 mol % and more preferably 6 to 13 mol %.

The PVA-based resin can be produced by a known method such as bulk polymerization, solution polymerization, suspension polymerization, and emulsion polymerization. Generally, a bulk polymerization or solution polymerization in the absence of solvent or in the presence of a solvent such as alcohol are employed. Examples of the solvent for the solution polymerization include lower alcohols such as methyl alcohol, ethyl alcohol and propyl alcohol. The copolymerization is performed in the presence of a known initiator, for example, an azo initiator or peroxide initiator such as a,a'-azobisisobutyronitrile, 2,2'-azobis(2,4-dimethyl-varelonitrile), benzoyl peroxide, and n-propyl peroxycarbonate. The polymerization temperature is not critical and a range of from 0 to 150° C. is recommended.

Since the composite fibers containing the PVA-based resin as the removable component and the heat-shrinkable resin as the microfine fiber-forming component is bulky, the composite fibers are not damaged during the needle punching. Therefore, the nonwoven fabric is hardly made rigid and coarse. When containing a small amount of water, the PVA-based resin is plasticized to some extent. When letting the composite fibers shrink by the heat treatment in the plasticized state, the nonwoven fabric is easily and stably densified. By impregnating an aqueous emulsion of elastic polymer into a highly densified nonwoven fabric at low temperatures so as to prevent the PVA-based resin from dissolving in water, and then, converting the composite fibers to microfine fibers by removing the PVA-based resin with water, voids are formed between the microfine fibers and the elastic polymer. Thus, the substrate for artificial leathers can be made densified and flexible at the same time. The artificial leathers made of the substrate for artificial leathers produced in such manner acquire a drapeability and a hand closely resembling those of natural leathers.

The content of the sea component in the sea-island fibers is preferably 5 to 70% by mass, more preferably 10 to 60% by mass, and still more preferably 15 to 50% by mass. If the content is 5% by mass or more, the composite fibers are stably spun. In addition, since the removable component is contained in a sufficient amount, a sufficient amount of voids is formed between the microfine fibers and the elastic polymer, to provide artificial leathers with good flexibility. When the removable component is excessively contained, a large amount of the elastic polymer is unfavorably required for stabilizing the shape of artificial leathers. If the content is 70% by mass or less, however, such a large amount of the elastic polymer is not needed. Also, as described above, an excessively large amount of water is not required to plasticize the PVA-based resin in the step of shrinking the composite fibers. Therefore, the heat for drying can be saved, to enhance the productivity. In addition, an insufficient shrink and a place-to-place uneven shrink do not occur, to make the production stable.

The microfine fiber-forming fibers (composite fibers such as sea-island fibers) which are obtained by spinning and drawing so as to have a desired fineness may be cut to staples having a desired length after crimping and then the staples may be made into a fiber web by a carding machine, cross-lapper or random webber in the same manner as employed in the production of known substrate for artificial leathers. However, in the present invention, the microfine fiber-forming fibers are preferably made into a long fiber web, without cutting to staples, by a spun bond method which is directly combined with the melt spinning operation. For example, microfine fiber-forming fibers extruded from a spinning nozzle are cooled by a cooling apparatus, drawn to an intended fineness by air jet at a speed corresponding to a take-up speed of 1000 to 6000 m/min using a sucking apparatus such as an air jet nozzle, and then collected on a moving surface while opening the fibers. After partially pressing the collected long fibers to stabilize the shape, if needed, a long fiber web is obtained. This method of producing long fiber webs is advantageous in productivity, because it does not need a series of large apparatuses such as a raw fiber feeder, an apparatus for opening fibers and a carding machine which are necessarily used in the production method of short fiber webs. In addition, since the long-fiber nonwoven fabric and the substrate for artificial leathers made thereof are constituted by long fibers with high continuity, the properties thereof such as strength are high as compared with those of the short-fiber nonwoven fabric and the substrate for artificial leathers made thereof which have been hitherto generally used. The mass per unit area of the long fiber web is preferably 20 to 500 g/m$^2$ in view of easiness of handling and stability of quality.

In case of using short fibers, the fineness, fiber length and degree of crimp need to be adjusted for an apparatus for opening fibers, a carding machine, etc. to be used. For example, the fineness of the microfine fiber-forming short fibers is limited to 2 dtex or more, and 3 to 6 dtex is generally employed in view of stability. In contrast, in case of using long fibers, there is substantially no limitation by the apparatus. The fineness of the microfine fiber-forming long fibers can be selected from a wide range of about 0.5 dtex or more, or 1 to 10 dtex even taking the handling properties in subsequent steps into consideration.

In view of the properties and hand of the resultant substrate for artificial leathers, the average single fiber fineness of the microfine fiber-forming long fibers is preferably 1 to 5 dtex. The fineness, shape of cross section, content of removable component of the microfine fiber-forming fibers are preferably controlled so as to obtain the microfine fibers having an average single fiber fineness of 0.0003 to 0.5 dtex. The number of islands of the sea-island composite fibers is preferably 9 to 1000. A fiber length longer than about 10 to 50 mm typical to short fibers is sufficient for the microfine fiber-forming long fibers, and 100 mm or longer is preferred. The fiber length may be several meters, hundreds of meter, or several kilo-meters as long as being technically possible to produce or being not physically broken.

Then the long fiber web is made into an entangled nonwoven fabric by the entangling treatment such as needle punching, after superposing two or more webs if necessary. The apparent density of the entangled nonwoven fabric is preferably 0.1 to 0.2 g/cm$^3$ and more preferably 0.13 to 0.2 g/cm$^3$. To achieve the softness resembling natural sheep skins, the apparent density of the entangled nonwoven fabric is preferably as low as possible. However, if less than 0.1 g/cm$^3$, a nonwoven fabric with a uniform structure is difficult to obtain. Therefore, the properties become largely uneven in the area direction and a substrate for artificial leathers realizing the properties and hand required for artificial leathers is difficult to obtain. As described below, it is preferred in the present invention to heat-treat the entangled nonwoven fabric. By this heat treatment, the microfine fiber-forming fibers shrink to result in the area shrinking of the entangled nonwoven fabric, thereby obtaining a densified structure of entangles fibers not attained by the entangling treatment alone. If the apparent density is less than 0.1 g/cm$^3$, however, a uniform and densified structure of entangled fibers is difficult to obtain even if the area shrinkage by the heat treatment is large. The apparent density is determined by calculating the mass per unit area from the measured mass of the entangled nonwoven fabric having a given surface area, separately measuring the thickness of the entangled nonwoven fabric under a load of 0.7 gf/cm$^2$, and then dividing the mass per unit area by the thickness.

The needle punching conditions such as the gauge and length of needles, the number and shape of barbs, the punching depth, the density of disposed needles and the number of punching per unit area are selected from those employed in the production of known substrate for artificial leathers. For example, the number of barbs is preferably 1 to 9 per needle and the punching density is preferably 500 to 5000 puch/cm$^2$. In view of the efficient entanglement, the punching is preferably performed so that the barb closest to the tip of barb penetrates through the opposite side of the long fiber web. To prevent the needle break and the buildup of static electricity, the fiber web may be provided with an oil agent before or during the entangling treatment.

Then, the microfine fiber-forming fibers oriented to the thickness direction by the entangling treatment are preferably caused to heat-shrink, thereby densifying the entangled nonwoven fabric. If the sea component of the microfine fiber-forming fibers is the PVA-based resin, the heat shrinking is preferably performed at a relative humidity of 75 to 95% after impregnating water into the entangled nonwoven fabric uniformly in an amount of 5% by mass or more of the total amount of the PVA-based resin. More preferably, the heat shrinking is conducted at a relative humidity of 90 to 95% after adding 10% by mass or more of water. The ambient temperature of the heat shrinking treatment is preferably 60 to 95° C., because the treatment is easily controlled by the apparatus and the microfine fiber-forming fibers shrink sufficiently to make the entangled nonwoven fabric more densified. If water is added 5% by mass or more, the sea component of the microfine fiber-forming fibers is sufficiently plasticized to allow the island component to shrink sufficiently. If the relative humidity is 75% or more, the sea component is prevented from being hardened because rapid evaporation of the added water is avoided, to ensure a sufficient shrinking. The upper limit of the amount of water to be added is not critical, and preferably 50% by mass or less of the total amount of the PVA-based resin in view of preventing the contamination of the process line due to eluted PVA-based resin and enhancing the drying efficiency. The amount of water to be added mentioned above is based on the amount of the PVA-based resin in the entangled nonwoven fabric after keeping under the standard state (23° C., 65% RH) for 24 h.

The addition of water is conducted by a method of sprinkling water onto the entangled nonwoven fabric, a method of providing steam or mist of water droplets to the entangled nonwoven fabric, or a method of applying water onto the surface of the entangled nonwoven fabric, with the method of providing steam or mist of water droplets to the entangled nonwoven fabric being particularly preferred. It is preferred that the water to be added has a temperature substantially not dissolving PVA-based resin. The heat shrinking treatment may be conducted at a relative humidity of 75% or more after adding water to the entangled nonwoven fabric or may be conducted simultaneously with the addition of water. During the heat shrinking treatment, the entangled nonwoven fabric is kept in the above atmosphere without tension as much as possible. The heat shrinking time is preferably 1 to 5 min in view of the productivity and a sufficient shrinking.

The area shrinkage by the heat-shrinking treatment is preferably 15% or more and more preferably 30% of more. If being 15% or more, the entangled nonwoven fabric has a sufficiently high apparent density, thereby having an enhanced shape retention. Therefore, the handling ability and the process-passing properties (properties that the treatment intended in a processing step is successively done and the treated product is transferred to the next processing step without causing any troubles) are improved to make it possible to obtain a substrate for artificial leathers with a high strength. In addition, since the use of a large amount of the elastic polymer (binder resin) is avoided because of a good shape retention, a natural leather-like softness with stiffness is obtained. By the heat shrinking in the above manner, the microfine fiber-forming fibers still containing the removable component shrink, to provide an entangled nonwoven fabric preferably having an apparent density of 0.3 to 0.7 g/cm$^3$. The area shrinkage is preferably about 60% or less in view of a uniform shrinking.

To make the surface smooth and adjust the apparent density, the entangled nonwoven fabric is preferably hot-pressed at 110 to 200° C. so as to have an apparent density of 0.4 to 0.8 g/cm$^3$, while the water added for the heat-shrinking treatment still remains and the removable component (PVA-based resin) is still in the plasticized or molten state. If the apparent density after the hot press is 0.4 g/cm$^3$ or more, the surface is sufficiently smooth, the apparent density is sufficiently high and the shape retention is good. Therefore, the handling ability and the process-passing properties in the production process are improved to make it possible to obtain a substrate for artificial leathers with a sufficiently high strength. In addition, since the use of a large amount of the elastic polymer (binder resin) is avoided because of a good shape retention, a natural leather-like softness with stiffness is obtained. The apparent density after the hot press is preferably 0.8 g/cm$^3$ or less because a sufficient amount of voids is formed between the microfine fibers and the elastic polymer in the subsequent production steps, to provide an artificial leather with a good softness.

After or without performing the heat-shrinking treatment and/or the hot press for adjusting the apparent density and hand and making the surface smooth, water is added to only the surface portion of the entangled nonwoven fabric and then the removable component (PVA-based resin) is plasticized or melted. By hot-pressing the entangled nonwoven fabric while keeping this state so as to make only the surface portion densified or into film, a substrate for artificial leathers, which can be made into a grain-finished artificial leather combining the high peeling strength, softness without resistance and hand with stiffness required in the application to sport shoes and further having fine bent wrinkles, is obtained.

In the subsequent production steps, the entangled nonwoven fabric is impregnated with an aqueous emulsion of the elastic polymer (binder resin) such as polyurethane and then the elastic polymer is coagulated. Since the aqueous emulsion of the elastic polymer easily migrates during the coagulation step and drying step to the surface of the entangled nonwoven fabric, the elastic polymer is concentrated in the surface of the substrate for artificial leathers. To improve the water resistance after coagulating and drying the elastic polymer, a crosslinked elastic polymer is generally used. However, the crosslinked elastic polymer is poor in adhesive properties. Therefore, in the production of a grain-finished artificial leather by laminating a skin layer (grain layer) on a substrate for artificial leathers via an adhesive, the elastic polymer on the surface of the substrate for artificial leathers decreases the adhesiveness of the used adhesive and makes the adhesion strength between the skin layer and the substrate for artificial leathers poor.

In the present invention, preferably after adjusting the apparent density to 0.4 to 0.8 g/cm$^3$ by the hot press, water is added only to the surface of the entangled nonwoven fabric and only the removable component (PVA-based resin) in the surface portion is plasticized or melted. Then, the entangled nonwoven fabric is hot-pressed while keeping the above state, thereby making only the portion added with water, i.e., only the surface portion of the entangled nonwoven fabric densified or into a film. Such a densified surface portion prevents the impregnated aqueous emulsion of the elastic polymer from migrating into the surface of the entangled nonwoven fabric. Therefore, a substrate for artificial leathers having a densified surface portion made of microfine fibers free from the elastic polymer is obtained. The thickness of the densified layer is determined by the depth of the penetrated water, because the portion added with water is made densified or into film.

The water for forming the densified layer is added by a method of sprinkling water onto the surface, a method of providing steam or mist of water droplets to the surface or a method of applying water onto the surface, with a method by a gravure coating or spraying being particularly preferred because a small amount of water is uniformly added.

The thickness of the densified layer is preferably 1 to 10% of the total thickness of the substrate for artificial leathers and suitably adjusted by changing the amount of water to be added within a range of 5 to 100 g per 1 m$^2$ surface of the entangled nonwoven fabric. It is sufficient for the hot press to conduct at temperatures (preferably 110 to 130° C.) at which the water used to plasticize the PVA-based resin is evaporated, thereby allowing the PVA-based resin to be fixed in a shrunk state. A temperature as high as softening the PVA-based resin is not required. The densified layer thus formed is required to have a denseness enough to prevent the elastic polymer from migrating into the surface of the substrate for artificial leathers. For example, the apparent density of the densified layer is preferably 0.8 to 1 g/cm$^3$.

If the hot press is conducted without adding water, high temperatures are required to softening the PVA-based resin. In addition, the apparent density inside the entangled nonwoven fabric is unfavorably increased and the densified layer located only the vicinity of the surface cannot be effectively obtained. If hot-pressing an entangled nonwoven fabric which comprises microfine fiber-forming fibers containing a heat-adhesive resin such as polyethylene as the removable component, the apparent density inside the entangled nonwoven fabric is also increased due to the heat applied, thereby failing to make only the surface portion densified.

Then, the entangled nonwoven fabric having its surface densified is impregnated with an aqueous emulsion of the elastic polymer (binder resin) and impregnated elastic polymer is coagulated. The amount (solid basis) of the elastic polymer to be impregnated is 1 to 40% by mass and preferably 3 to 25% by mass of the mass of the substrate for artificial leathers. Within the above range, the microfine fibers are sufficiently fixed, and fine bent wrinkles and good shape retention and surface smoothness are obtained. In addition, the hand is not hardened to prevent the elastic properties of the elastic polymer from being predominant, and the natural leather-like softness with small resistance is obtained.

Examples of the elastic polymer include synthetic resins such as polyvinyl chloride, polyamide, polyester, polyester-ether copolymer, polyacrylic ester copolymer, polyurethane, neoprene, styrene-butadiene copolymer, silicone resin, polyamino acid and polyamino acid-polyurethane copolymer, natural high molecular resin, and mixtures thereof. An elastic polymer capable of being made into an aqueous emulsion is preferred in view of obtaining a grain-finished artificial leather combining a soft hand and a dense feeling. More preferred is an elastic polymer (binder resin) comprising polyurethane in view of combining the above hand and good physical properties. If necessary, a pigment, a dye, a crosslinking agent, a filler, a plasticizer, a stabilizer, etc. may be added. Since a soft hand is obtained, polyurethane or a mixture of polyurethane and another resin is preferably used.

The method of providing the aqueous emulsion of the elastic polymer is not specifically limited and a known method such as immersion method, spray method and application method is employed. For example, a method in which an aqueous emulsion is applied to the surface opposite to the densified surface of the entangled nonwoven fabric and allowed to impregnate thereinto is preferably used because a surface free from the elastic polymer is obtained. The impregnated elastic polymer is coagulated by a wet method such as a hot water treatment at 70 to 100° C. and a steam treatment at 100 to 200° C. or a dry method such as a heat treatment in a dryer at 50 to 200° C., preferably by the dry method. The concentration of the elastic polymer in the aqueous emulsion is preferably 3 to 40% by mass.

After impregnating, coagulating and drying the aqueous emulsion, the microfine fiber-forming fibers are converted to bundles of microfine fibers by removing the removable component (PVA-based resin) by the extraction with water. The removal by extraction is performed using a dyeing machine such as a jet dyeing machine and a jigger, or a scouring machine such as an open soaper, although not limited thereto. The water temperature in the extraction bath is preferably selected from the range of 80 to 95° C. and the extraction time is preferably selected from the range of 5 to 120 min, while taking the method to be employed, the density of the nonwoven fabric and the proportion of the components in the microfine fiber-forming fibers into consideration because the extraction efficiency largely changes according to these factors. It is preferred to remove the most or entire removable component by repeating the immersion of the nonwoven fabric impregnated with the elastic polymer in the extraction bath and the subsequent squeeze of water, because the treating time may be reduced to about 5 to 30 min.

The average single fiber fineness of the microfine fibers thus obtained is preferably 0.0003 to 0.5 dtex, more preferably 0.005 to 0.35 dtex, and still more preferably 0.01 to 0.2 dtex. If being 0.0003 dtex or more, the unfavorable densification due to the collapse of nonwoven fabric structure is prevented, to obtain a light-weight, soft substrate for artificial leathers. If being 0.5 dtex or less, a substrate for artificial leathers having a flexibility without resistance and a grain-finished artificial leather having a good surface smoothness and fine bent wrinkles can be obtained. The apparent density of the obtained substrate for artificial leathers is preferably 0.45 to 0.75 g/cm$^3$ and more preferably 0.50 to 0.65 g/cm$^3$, because the dense feeling and flexibility resembling natural leathers are obtained.

After the conversion to microfine fibers, by buffing the surface of the surface portion (densified layer) using sandpaper, a substrate for artificial leathers having the surface portion (densified layer) comprising the microfine fibers and free from the elastic polymer (binder resin) is obtained. A grain-finished artificial leather is obtained by bonding a film of an elastic polymer, for example, which is formed on a releasing paper, to the surface of the surface portion (densified layer) of the obtained substrate for artificial leathers via an adhesive; drying; optionally allowing the crosslinking reaction to proceed sufficiently; and then peeling off the releasing paper. Since the surface of the surface portion (densified layer) of the substrate for artificial leathers is substantially free from the elastic polymer (the content of the elastic polymer (binder resin) in the surface portion (densified layer) is 2% by mass or less (inclusive of zero)), the adhesion strength between the substrate for artificial leathers and the skin layer (grain layer) is good. The elastic polymer for the skin layer, the thickness of the skin layer, the adhesive, the method of adhesion, the drying method, the conditions of crosslinking reaction, etc. may be suitably selected from those employed in the production of known grain-finished artificial leathers. Particularly, the elastic polymer for the grain layer is preferably polyurethane in view of enhancing the appearance by preventing buckling wrinkles and more preferably at least one elastic polymer selected from polycarbonate-based polyurethane, polyether-based polyurethane and silicone-modified polyurethane because the bending properties, durability and peeling strength are good. When the skin layer is bonded via an adhesive layer (4 in the FIGURE), the elastic polymer for the adhesive layer is preferably polyurethane because the adhesion to the microfine fibers forming the surface of the surface portion (densified layer) of the substrate for artificial leathers or the adhesion to the binder resin (elastic polymer constituting the grain layer) is good, and more preferably a crosslinkable (two-part) polyurethane because the balance between the adhesion strength and hand is good.

The grain-finished artificial leather of the invention combines a high peeling strength, a softness without resistance and a hand with stiffness, and further has fine bent wrinkles, therefore, suitable as the material for the production of shoes, bags, baseball gloves, belts, balls and interior products such as sofas.

EXAMPLES

The present invention will be described in more detail with reference to the examples. However, it should be noted that the scope of the present invention is not limited thereto. The "part(s)" and "%" used hereinafter is based on the mass unless otherwise noted. Each measurement was carried out by the method mentioned below and each result is expressed by an average value of five measured values unless otherwise noted.

(1) Average Fineness of Fibers

Calculated from the density of the resin constituting the fibers and the cross-sectional area of the fibers determined by a scanning electron photomicrograph (magnification of few hundreds to few thousands).

(2) Melting Point of Resin

Using DSC (TA3000 manufactured by Mettler Co. Ltd.), the sample was heated to 300° C. at a temperature rising rate of 10° C./min in nitrogen atmosphere, cooled to room temperature, and then, heated again to 300° C. at a temperature rising rate of 10° C./min. The peak top temperature of the obtained endothermic curve is taken as the melting point.

(3) Hand

The hand of a sample was evaluated by five panelists according to the following ratings:

A: soft hand with no resistance

B: soft hand with resistance

C: hard hand with resistance (3) Buckling Wrinkles

A 4 cm×4 cm sample was clipped along two lengthwise ends (or two widthwise ends) at 1 cm inside from the edges.

Then, the interspace between two clipped portions was narrowed from 2 cm to 1 cm so as to allow the skin layer (grain surface) to bend inside. Thereafter, the number of buckling wrinkles formed on the skin layer was visually counted and evaluated according to the following ratings.

A: 0-2 buckling wrinkles

B: 3-4 buckling wrinkles

C: 5-7 buckling wrinkles

D: 8 or more buckling wrinkles (4) Peeling Strength

A sample of 25 cm long and 2.5 cm wide was bonded to a rubber plate of 2.5 cm wide and 15 cm long (bonded length: 9 cm). The sample was peeled from the rubber plate by pulling at a speed of 10 cm/min along the direction parallel to the bonded surface. The average stress during the peeling was determined.

Production Example 1

Production of Water-Soluble, Thermoplastic Polyvinyl Alcohol-Based Resin

A 100-L pressure reactor equipped with a stirrer, a nitrogen inlet, an ethylene inlet and an initiator inlet was charged with 29.0 kg of vinyl acetate and 31.0 kg of methanol. After raising the temperature to 60° C., the reaction system was purged with nitrogen by bubbling nitrogen for 30 min. Then, ethylene was introduced so as to adjust the pressure of the reactor to 5.9 kgf/cm$^2$. A 2.8 g/L methanol solution of 2,2'-azobis(4-methoxy-2,4-dimethylvaleronitrile) was purged with nitrogen by nitrogen gas bubbling. After adjusting the temperature of reactor to 60° C., 170 mL of the initiator solution was added to initiate the polymerization. During the polymerization, the pressure of reactor was maintained at 5.9 kgf/cm$^2$ by introducing ethylene, the polymerization temperature was maintained at 60° C., and the initiator solution was continuously added at a rate of 610 mL/h. When the conversion of polymerization reached 70% after 10 h, the polymerization was terminated by cooling.

After releasing ethylene from the reactor, ethylene was completely removed by bubbling nitrogen gas. The non-reacted vinyl acetate monomer was removed under reduced pressure to obtain a methanol solution of polyvinyl acetate, which was then diluted to 50% concentration with methanol. To 200 g of the 50% methanol solution of polyvinyl acetate (100 g of polyvinyl acetate in the solution), 46.5 g of a 10% methanol solution of NaOH was added. The molar ratio of NaOH/vinyl acetate unit was 0.10. After about 2 min of the addition of the alkali solution, the system was gelated. The gel was crushed by a crusher and allowed to stand at 60° C. for one hour to allow the saponification to proceed. Then, 1000 g of methyl acetate was added. After confirming the completion of neutralization of the remaining alkali by phenolphthalein indicator, white solid (modified PVA) was separated by filtration. The white solid (modified PVA) was added with 1000 g of methanol and allowed to stand at room temperature for 3 h for washing. After repeating the above washing operation three times, the liquid was centrifugally removed and the solid remained was dried at 70° C. for 2 days to obtain a dried modified PVA.

The saponification degree of the ethylene-modified PVA was 98.4 mol %. The modified PVA was incinerated and dissolved in an acid for analysis by atomic-absorption spectroscopy. The content of sodium was 0.03 part by mass based on 100 parts by mass of the modified PVA. After repeating three times the reprecipitation-dissolution operation in which n-hexane is added to the methanol solution of polyvinyl acetate obtained by removing the non-reacted vinyl acetate monomer after the polymerization to cause precipitation and acetone is then added for dissolution, the precipitate was vacuum-dried at 80° C. for 3 days to obtain a purified polyvinyl acetate. The polyvinyl acetate was dissolved in d6-DMSO and analyzed by 500 MHz H-NMR (JEOL GX-500) at 80° C. The content of ethylene unit was 10 mol %.

The above methanol solution of polyvinyl acetate was added with a 10% methanol solution of NaOH. The molar ratio of NaOH/vinyl acetate unit was 0.5. The resultant gel was crushed and the saponification was allowed to proceed by standing at 60° C. for 5 h. The saponification product was extracted by Soxhlet with methanol for 3 days and the obtained extract was vacuum-dried at 80° C. for 3 days to obtain a purified, ethylene-modified PVA. The average polymerization degree of the purified, modified PVA was 330 when measured by a method of JIS K6726. The content of 1,2-glycol linkage and the content of three consecutive hydroxyl groups in the purified, modified PVA were respectively 1.50 mol % and 83% when measured by 5000 MHz H-NMR (JEOL GX-500). A 5% aqueous solution of the purified, modified PVA was made into a cast film of 10 μm thick, which was then vacuum-dried at 80° C. for one day and then measured for the melting point in the manner described above. The melting point was 206° C.

Example 1

The water-soluble, thermoplastic PVA (ethylene-modified PVA, sea component) produced above and an isophthalic acid-modified polyethylene terephthalate (degree of modification of 6 mol %, island component) were extruded at 260° C. form a spinneret for melt composite spinning (number of islands: 25 per one microfine fiber-forming fiber) in a sea component/island component ratio of 30/70 (by mass). The ejector pressure was regulated such that the spinning speed was 4500 m/min. The long fibers were collected on a net, to obtain a long fiber web having a mass per unit area of 30 g/m$^2$ which was composed of microfine fiber-forming fibers having an average fineness of 2.0 dtex.

A superposed body of 12 long fiber webs prepared by crosslapping was sprayed with an oil agent for preventing needle break, and then, subjected to needle punching alternately from both sides at a density of 3000 punch/cm$^2$ and a punching depth of 8 mm using single-barb needles (tip-to-barb distance: 3 mm; throat depth: 0.06 mm), to obtain an entangled nonwoven fabric.

The entangled nonwoven fabric of long fibers was added with 30% by mass of water based on the amount of PVA and heat-treated at a relative humidity of 95% and 70° C. for 3 min by standing under a tension-free condition. The entangled nonwoven fabric shrunk by the heat treatment at an area shrinkage of 52% to increase the apparent density. The heat-treated nonwoven fabric was pressed by a hot roll at 120° C., to obtain a nonwoven fabric with a smooth surface, which had a mass per unit area of 910 g/m$^2$ and an apparent density of 0.50 g/cm$^3$. After adding water to one surface of the nonwoven fabric in an amount of 20 g/m$^2$ using gravure rolls, the nonwoven fabric was pressed by a roll at 120° C. to densify only the surface portion, thereby obtaining a nonwoven fabric having an overall apparent density of 0.65 g/cm$^3$. The pressed surface was a luster, smooth surface. The observation of the cross section under an electron microscope showed that a film layer of about 50 μm thick was formed in the pressed surface.

The nonwoven fabric having its surface densified was impregnated with an aqueous polyurethane emulsion ("Superflex E-4800" manufactured by Dai-Ichi Kogyo Seiyaku Co., Ltd.) by dipping, and dried and cured at 150° C., to obtain a resin-containing nonwoven fabric in which the ratio of binder resin/microfine fiber-forming fibers was 6/94 was obtained. The resin-containing nonwoven fabric was then dipped in a hot water of 95° C., to remove PVA by dissolution. Then the surface was buffed to remove the binder resin adhered to the surface during the dipping, thereby obtaining a substrate for artificial leathers having a surface made of microfine fibers and free from the binder resin. The single fiber fineness of microfine long fibers was 0.1 dtex.

Separately, a mixture of 100 parts of a solution of one-part polyurethane resin ("NY324," a polycarbonate-type, silicone-modified polyurethane resin manufactured by Dainippon Ink & Chemicals, Inc., solid content: 30%), 10 parts of DMF (dimethylformamide) and 10 parts of MEK (methyl ethyl ketone) was coated on a releasing paper to form a polyurethane film of 50 μm thick. The polyurethane film was superposed on the densified surface of the substrate for artificial leathers through a mixture of 100 parts of a crosslinkable (two-part) urethane adhesive ("Krysbon TA-205" manufactured by Dainippon Ink & Chemicals, Inc., solid content: 50%), 15 parts of a hardener ("DN-950" manufactured by Dainippon Ink & Chemicals, Inc., solid content: 80%) and 3 parts of an accelerator ("Accel T" manufactured by Dainippon Ink & Chemicals, Inc.). After drying and allowing the crosslinking reaction to proceed sufficiently, the releasing paper was peeled off to obtain a grain-finished artificial leather. The obtained grain-finished artificial leather had a high peeling strength between the grain layer and the substrate for artificial leathers, combined a softness without resistance and a hand with stiffness, and further had fine bent wrinkles.

Example 2

The entangled nonwoven fabric produced in Example 1 was added with water in an amount of 30% by mass of PVA and heat-treated in an atmosphere of 95% relative humidity and 70° C. for 3 min under a tension-free condition. By the heat treatment, the entangled nonwoven fabric shrunk in an area shrinkage of 52% to increase the apparent density. The heat-treated entangled nonwoven fabric was pressed by a hot roll at 120° C., to obtain a smoothened nonwoven fabric having a mass per unit area of 910 g/m$^2$ and an apparent density of 0.50 g/cm$^3$. After adding water to one surface of the nonwoven fabric in an amount of 35 g/m$^2$ using gravure rolls, the surface was pressed by a roll at 120° C. to densify only the surface portion, thereby obtaining a nonwoven fabric having an overall apparent density of 0.69 g/cm$^3$. The pressed surface was a luster, smooth surface. The observation of the cross section under an electron microscope showed that a film layer of about 70 μm thick was formed in the pressed surface.

The nonwoven fabric having its surface densified was impregnated with an aqueous polyurethane emulsion (Superflex E-4800) by dipping, and dried and cured at 150° C., to obtain a resin-containing nonwoven fabric in which the ratio of binder resin/microfine fiber-forming fibers was 6/94 was obtained. The resin-containing nonwoven fabric was then dipped in a hot water of 95° C., to remove PVA by dissolution. Then the surface was buffed to remove the binder resin adhered to the surface during the dipping, thereby obtaining a substrate for artificial leathers having a surface made of microfine fibers and free from the binder resin. The single fiber fineness of microfine long fibers was OA dtex.

A grain layer was formed on the densified surface of the substrate for artificial leathers in the same manner as in Example 1, to obtain a grain-finished artificial leather. The obtained grain-finished artificial leather had a high peeling strength between the grain layer and the substrate for artificial leathers, combined a softness without resistance and a hand with stiffness, and further had fine bent wrinkles.

Comparative Example 1

A grain-finished artificial leather was produced in the same manner as in Example 1 except for omitting the surface-densifying treatment by a hot press in the presence of water before the impregnation of the aqueous polyurethane emulsion. Although having a good hand, the obtained grain-finished artificial leather had a poor peeling strength between the grain layer and the substrate for artificial leathers, easily formed buckling wrinkles, and was poor in the dense feeling.

Comparative Example 2

A grain-finished artificial leather was produced in the same manner as in Example 1 except for hot-pressing the nonwoven fabric at 120° C. without adding water to the surface before the impregnation of the aqueous polyurethane emulsion, thereby adjusting the apparent density to 0.65 g/cm$^3$. Although having fine bent wrinkles, the obtained grain-finished artificial leather had a hard hand and a poor peeling strength between the grain layer and the substrate for artificial leathers.

TABLE 1

| | Examples | | Comparative Examples | |
|---|---|---|---|---|
| | 1 | 2 | 1 | 2 |
| thickness (mm) | 1.40 | 1.40 | 1.55 | 1.42 |
| peeling strength (kg/2.5 cm) | 13.8 | 13.0 | 7.8 | 8.5 |
| hand | A | A | B | C |
| buckling wrinkles | A | A | D | B |

INDUSTRIAL APPLICABILITY

The grain-finished artificial leather of the present invention combines a high peeling strength, softness without resistance and hand with stiffness each required in the application to sport shoes, and further has fine bent wrinkles. Therefore, the grain-finished artificial leather is suitable as the material for the production of artificial leather products such as shoes, balls, furniture, vehicle seats, baseball gloves, bags and belts.

What is claimed is:

1. A method of producing a substrate, the method comprising:

(1) producing an entangled nonwoven fabric comprising microfine fiber-forming fibers comprising a water-soluble, thermoplastic polyvinyl alcohol-based resin as a removable component;

(2) adding water to at least one surface of the entangled nonwoven fabric and hot-pressing the surface added with water, to obtain a nonwoven fabric comprising (i) a densified layer and (ii) a portion other than the densified layer;

(3) impregnating an aqueous emulsion of a binder resin into the portion other than the densified layer and coagulating the impregnated binder resin; and (4) converting the microfine fiber-forming fibers into bundles of microfine fibers by extracting the water-soluble, thermoplastic polyvinyl alcohol-based resin, to obtain a substrate that is suitable for an artificial leather.

2. The method of claim 1, wherein the hot-pressing comprises plasticizing or melting the polyvinyl alcohol-based resin present in the densified layer.

3. The method of claim 1, wherein the densified layer has a density sufficient to prevent the binder resin from migrating into a surface of the entangled nonwoven fabric.

4. The method of claim 1, wherein the microfine fiber-forming fibers have a length of more than 50 mm.

5. The method of claim 1, wherein a thickness of the densified layer is 1 to 10% of a total thickness of the substrate.

6. The method of claim 1, wherein the densified layer comprises 2% by mass or less of the binder resin, based on a mass of the densified layer.

7. The method of claim 1, wherein the polyvinyl alcohol-based resin has a melting point of 160 to 230° C.

8. The method of claim 1, wherein the polyvinyl alcohol-based resin has a melting point of 180 to 220° C.

9. The method of claim 1, wherein an apparent density of the entangled nonwoven fabric prior to the hot-pressing is 0.1 to 0.2 g/cm$^3$.

10. The method of claim 1, wherein an apparent density of the entangled nonwoven fabric prior to the hot-pressing is 0.13 to 0.2 g/cm$^3$.

11. The method of claim 1, wherein the hot-pressing is performed at a relative humidity of 75 to 95%.

12. The method of claim 1, wherein the hot-pressing is performed at a relative humidity of 90 to 95%.

13. The method of claim 11, wherein water is added to the surface of the entangled nonwoven fabric in an amount of 5% to 50% by mass or more, based on an amount of the polyvinyl alcohol-based resin.

14. The method of claim 12, wherein water is added to the surface of the entangled nonwoven fabric in an amount of 10% to 50% by mass or more, based on an amount of the polyvinyl alcohol-based resin.

15. The method of claim 1, wherein water is added to the surface of the entangled nonwoven fabric in an amount of 5 to 100 g per 1 m$^2$ of surface area of the entangled nonwoven fabric.

16. The method of claim 1, wherein an apparent density of the entangled nonwoven fabric after the hot-pressing is 0.3 to 0.7 g/cm$^3$.

17. The method of claim 1, wherein an apparent density of the entangled nonwoven fabric after the hot-pressing is 0.4 to 0.8 g/cm$^3$.

18. The method of claim 1, wherein an apparent density of the densified layer is 0.8 to 1 g/cm$^3$.

19. The method of claim 1, wherein the hot-pressing is performed at a temperature of 110 to 200° C.

* * * * *